US009749759B2

(12) United States Patent
Meyer et al.

(10) Patent No.: US 9,749,759 B2
(45) Date of Patent: Aug. 29, 2017

(54) SOUND TUBE FOR AN EARPIECE, SOUND TUBE ARRANGEMENT, EARPIECE WITH SUCH A SOUND TUBE OR SOUND TUBE ARRANGEMENT AND HEARING DEVICE WITH SUCH AN EARPIECE

(71) Applicant: Sonova AG, Stäfa (CH)

(72) Inventors: Jonas Meyer, Stäfa (CH); Martin Rahn, Stäfa (CH); Christoph Leist, Rapperswil (CH); Roland Hug, Hinwil (CH); Sven Keller, Wila/ZH (CH); Marco Breitler, Brüttisellen (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 15/033,487

(22) PCT Filed: Nov. 20, 2013

(86) PCT No.: PCT/EP2013/074315

§ 371 (c)(1),
(2) Date: Apr. 29, 2016

(87) PCT Pub. No.: WO2015/074693

PCT Pub. Date: May 28, 2015

(65) Prior Publication Data

US 2016/0269839 A1 Sep. 15, 2016

(51) Int. Cl.
*H04R 25/00* (2006.01)

(52) U.S. Cl.
CPC ..... *H04R 25/654* (2013.01); *H04R 25/60* (2013.01); *H04R 2225/023* (2013.01); *H04R 2225/025* (2013.01)

(58) Field of Classification Search
CPC ..... H04R 25/654; H04R 25/652
See application file for complete search history.

(56) References Cited

U.S. PATENT DOCUMENTS 4,553,627 A 11/1985 Gastmeier
4,972,488 A * 11/1990 Weiss ..... H04R 25/654 381/322

(Continued)

FOREIGN PATENT DOCUMENTS

EP 1097606 B1 10/2005
EP 1562400 B1 7/2008

OTHER PUBLICATIONS

PCT Search Report dated Jul. 7, 2014 for PCT App. Ser. No. PCT/EP2013/074315.

*Primary Examiner* — Matthew Eason
(74) *Attorney, Agent, or Firm* — Henricks, Slavin & Holmes LLP

(57) ABSTRACT

The present invention proposes a sound tube (3) for an earpiece (1), wherein a first section (4) of an inner surface of the sound tube (3) has a structured surface, in particular a textural pattern forming a relief comprising convexities (13) and/or concavities (11). Alternatively or additionally, the sound tube (3) features a radially extending, circumferential flange (8), annular lip (8') or collar at an outer surface of the sound tube (3). The present invention is further directed to a sound tube arrangement comprising two of the proposed sound tubes integrally formed in one piece and to an earpiece (1) with such a sound tube (3) or such a sound tube arrangement as well as to a hearing device with such an earpiece (1).

21 Claims, 4 Drawing Sheets

(56) References Cited

U.S. PATENT DOCUMENTS

| | | | | | |
|---|---|---|---|---|---|
| 5,105,904 | A * | 4/1992 | Olsen | H04R 25/654 | 181/128 |
| 5,208,867 | A | 5/1993 | Stites | | |
| 5,278,360 | A * | 1/1994 | Carbe | H04R 25/654 | 181/135 |
| 5,970,157 | A * | 10/1999 | Yoest | H04R 25/654 | 381/324 |
| 5,982,908 | A * | 11/1999 | Bauman | H04R 25/654 | 381/324 |
| 6,129,174 | A * | 10/2000 | Brown | H04R 25/656 | 181/135 |
| 8,233,649 | B2 * | 7/2012 | Gebert | H04R 25/654 | 381/316 |
| RE45,455 | E * | 4/2015 | Gunnersen | H04R 25/654 | 381/312 |
| 2004/0165742 | A1 * | 8/2004 | Shennib | H04R 25/456 | 381/326 |
| 2004/0240694 | A1 * | 12/2004 | Wolf | H04R 25/654 | 381/322 |
| 2006/0147071 | A1 * | 7/2006 | Neilson | H04R 25/654 | 381/325 |
| 2009/0316944 | A1 * | 12/2009 | Tiscareno | H04R 1/2896 | 381/346 |
| 2016/0219384 | A1 * | 7/2016 | Petersen | H04R 25/654 | |
| 2016/0286324 | A1 * | 9/2016 | van den Berg | H04R 25/608 | |

* cited by examiner

SOUND TUBE FOR AN EARPIECE, SOUND TUBE ARRANGEMENT, EARPIECE WITH SUCH A SOUND TUBE OR SOUND TUBE ARRANGEMENT AND HEARING DEVICE WITH SUCH AN EARPIECE

CROSS-REFERENCE TO RELATED APPLICATIONS

This application is the U.S. National Stage of PCT App. Ser. No. PCT/EP2013/074315, filed Nov. 20, 2013.

TECHNICAL FIELD

The present invention is generally related to the field of hearing devices and more particularly pertains to earpieces for being worn at least partially within an ear canal. Specifically, the present invention is related to a sound tube for connecting a sound port of a hearing device transducer with the exterior of an earpiece intended to be worn at least partially within an ear canal. The present invention is further directed to a sound tube arrangement and to an earpiece with a sound tube or a sound tube arrangement as well as to a hearing device with an earpiece.

BACKGROUND OF THE INVENTION

Ear-level hearing devices typically comprise a miniature loudspeaker (commonly also referred to as "receiver") which outputs sound into the ear canal of a user of the hearing device. Such hearing devices include ear phones, communication devices, hearing aids (also referred to as hearing prostheses or hearing instruments) for hard of hearing people or hearing enhancement devices for augmenting the hearing capability of normal hearing persons, as well as hearing protection devices designed to prevent noise-induced hearing loss and in-ear monitors. The receiver can be arranged in an earpiece (sometimes also referred to as "otoplastic") intended to be worn at least partially within an ear canal. This is for instance the case for in-the-ear (ITE)/in-the-canal (ITC), completely-in-canal (CIC) and receiver-in-the-ear (RITE) hearing devices. The sound output port of the receiver is then connected with a sound tube that extends to the exterior of the earpiece. In order to prevent ear wax, sweat, oil or other physiological debris entering into the sound tube from the ear canal, which may lead to clogging of the acoustic outlet passage, a wax guard (also referred to as cerumen protection) is usually employed. Replaceable ear wax guards are for instance known from U.S. Pat. No. 4,553,627, EP 1 097 606 B1 or EP 1 562 400 B1. Such replaceable wax guards have rather large dimensions, especially in view of very small CIC-type earpieces and devices intended to be inserted deeply into the ear canal, e.g. into the bony portion thereof. The size issue becomes especially critical when employing both a receiver and an ear canal microphone, thus requiring two wax guards. Furthermore, the wax guard is particularly strained when exposed to the harsh conditions prevailing in the ear canal—especially when it is sealed—for prolonged periods of time, e.g. for several days or weeks, during which the wax guard cannot be replaced, such as is for instance the case for extended-wear devices. Moreover, a partially polluted and blocked wax guard changes the electro-acoustical characteristics of the hearing device and will degrade its performance (in particular influence the stability of control algorithms such as feedback and occlusion cancelling). Additionally, the structure of such replaceable wax guards is quite complex, they have to fulfil stringent manufacturing tolerances, and are difficult to handle both with respect to automated hearing device assembly as well as manual replacement. Alternatively, US 2004/0165742 A1 discloses a deep insertion canal hearing device with a dual acoustic seal system, wherein a sound conduction tube extends beyond the primary seal and protrudes outwardly into the ear canal. This approach appears to do without a separate wax guard. However, once the extended tube is polluted it cannot be easily cleaned (as would be possible by replacing the previously mentioned replaceable wax guards). Hence, there is a need for simple solutions allowing reliable sound conduction for extended periods of time from a transducer located within an earpiece or hearing device worn at least partly within an ear canal to the exterior thereof, i.e. into the ear canal, and vice versa.

SUMMARY OF THE INVENTION

It is an object of the present invention to provide an improved sound tube allowing reliable sound conduction for prolonged periods of time from a transducer located within an earpiece or hearing device worn at least partly within an ear canal to the exterior thereof, i.e. into the ear canal, and vice versa (i.e. from the ear canal to the transducer). This object is reached by the hearing device according to claim 1.

It is a further goal of the present invention to provide a compact sound conduction solution suitable for earpieces and hearing devices employing both a receiver as well as an ear canal microphone. An appropriate sound tube arrangement is specified in claim 13.

An earpiece and a hearing device, respectively, incorporating such a sound tube or sound tube arrangement is given in claims 15 and 16, respectively.

Specific embodiments of the present invention are provided in the dependent claims.

The present invention is first directed to a sound tube for an earpiece, wherein the sound tube features at least one of:

- a first section of an inner surface of the sound tube has a structured surface, in particular a textural pattern forming a relief comprising convexities and/or concavities;
- a radially extending, circumferential flange, annular lip or collar at an outer surface of the sound tube.

The structured surface increases the length of the pathway along the inner surface of the sound tube within the first section towards the transducer and changes the properties of the tube for the propagation of contaminants, such as cerumen, sweat, oil and other liquids or physiological debris, from passing through the sound tube, in such a way that the travel time along this section of the sound tube is significantly increased for contaminants, so that it takes longer until the transducer is polluted and its performance degrades as a result thereof. This effect is enhanced by capillary forces resulting from the structured surface, which act on the contaminants. Moreover, contaminants are kept from entering into the outer end of the sound tube by the radially extending, circumferential flange, annular lip or collar, which is also additionally supported by capillary forces present at edges formed between the outer surface of the sound tube and the flange, lip or collar, which hold back the contaminants and inhibit their transportation into the sound tube.

In an embodiment of the sound tube a second section of the inner surface is substantially smooth, in particular lacks the structured surface of the first section.

In a further embodiment of the sound tube the first section and the second section are arranged adjacent to each other, and in particular together form the entire inner surface, and in particular the first section extends from a first end of the sound tube and the second section extends from a second end of the sound tube. By adjoining a substantially smooth second section subsequent to the structured first section a contaminate-free zone is established in front of the transducer.

In a further embodiment of the sound tube the structured surface has a textural pattern, in particular a periodic pattern.

In a further embodiment of the sound tube the structured surface comprises at least one of the following structures:

a groove or notch;

a protrusion, bulge or ridge.

In a further embodiment of the sound tube the structure extends circumferentially around a longitudinal axis of the sound tube.

In a further embodiment of the sound tube a contour of the structured surface is at least one of sawtooth-shaped, wave-shaped, jagged, lamellar.

In a further embodiment of the sound tube the structured surface comprises at least one circumferential edge, in particular at least one inward circumferential edge.

In a further embodiment of the sound tube the "roughness height" Rz value of the structured surface is in the range from 10 μm to half the inner diameter of the sound tube, and the "average roughness" Ra value of the structured surface is in the range from 10 μm to 1 mm. The "roughness height" Rz is the arithmetic mean value of the single roughness depths of consecutive sampling lengths, wherein "z" is the sum of the height of the highest peaks and the lowest valley depth within a sampling length. The "average roughness" Ra is the arithmetic average of the absolute values of the roughness profile ordinates. It is also known as "arithmetic average" (AA) and as "center line average" (CLA). The average roughness is the area between the roughness profile and its mean line, or the integral of the absolute value of the roughness profile height over the evaluation length.

In a further embodiment of the sound tube the structured surface forms a retarding zone adapted to restrain or impede contaminants, such as cerumen (ear wax), sweat, oil and other liquids or physiological debris, from passing through the sound tube.

In a further embodiment of the sound tube the radially extending, circumferential flange, annular lip or collar is arranged at a first end of the sound tube, in particular arranged away from the first end of the sound tube, more particularly arranged by less than 1/10 the length of the sound tube away from the first end of the sound tube.

In a further embodiment of the sound tube the radially extending, circumferential flange, annular lip or collar forms at least one inward circumferential edge with the outer surface of the sound tube.

The present invention is further directed to a sound tube arrangement, comprising two of the proposed sound tubes integrally formed in one piece.

In an embodiment the sound tube arrangement integrally comprises at least one of the following:

a first seating for a receiver;

a second seating for a microphone, in particular an ear canal microphone;

a mounting flange located in a central portion of the arrangement adapted to attach the arrangement to and/or support the arrangement at an earpiece.

The present invention is further directed to an earpiece to be worn at least partially within an ear canal, comprising a transducer and the proposed sound tube, a second end of the sound tube being connected with a sound port of the transducer and at least a portion of a first section of the sound tube with a first end of the sound tube extending outwardly from the earpiece, or comprising a receiver, a microphone (in particular an ear canal microphone) and the proposed sound tube arrangement.

The present invention is further directed to a hearing device, comprising the proposed earpiece.

It is pointed out that combinations of the above-mentioned embodiments give rise to even further, more specific embodiments according to the present invention.

The proposed sound tube or sound tube arrangement can be optionally equipped with an additional wax protection means at the outer (first) opening(s) of the sound tube (arrangement).

Furthermore, a cleaning tool such as a screw or spring remover can be used to clean the sound tube.

Moreover, the sound tube may be affixed to the earpiece in such a manner that it can be replaced by a hearing device professional without damaging the earpiece or hearing device, thus avoiding having to remake the earpiece.

The stated cleaning tool may also be employed to remove/exchange the mentioned additional wax protection means.

BRIEF DESCRIPTION OF THE DRAWINGS

The present invention is further explained below by means of non-limiting exemplary embodiments and with reference to the accompanying drawings, which show.

In the figures, like reference signs refer to like parts.

DETAILED DESCRIPTION OF THE INVENTION

Figure 1:
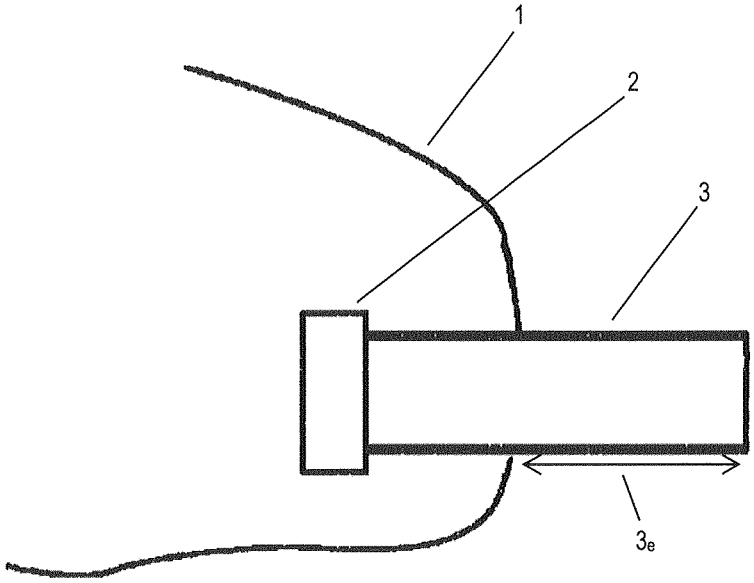
FIG. 1 a simplified cutaway side view of a portion of an earpiece with a transducer and a sound tube according to the prior art.

FIG. 1 shows a simplified cutaway side view of a portion of an earpiece 1 with a transducer 2 and a sound tube 3 according to the prior art (cf. e.g. US 2004/0165742 A1). A portion $\mathbf{3}_e$ of the sound tube 3 extends outwardly from the earpiece 1 towards the eardrum (or tympanic membrane; not shown) when the earpiece 1 is being worn in an ear canal (not shown). The advantage of this extended tube solution is the very simple assembly. However, it has drawbacks such as that the mechanical tolerances of the assembly process can lead to significant variances in the frequency response, and furthermore once the extended tube is polluted, it cannot be easily cleaned. Moreover, the smooth inner surface of the extended tube gives rise to undesired capillary effects, whereby liquids or other pollutants are draw into the tube. The capillary effects increase with decreasing diameter of the tube.

Figure 2:
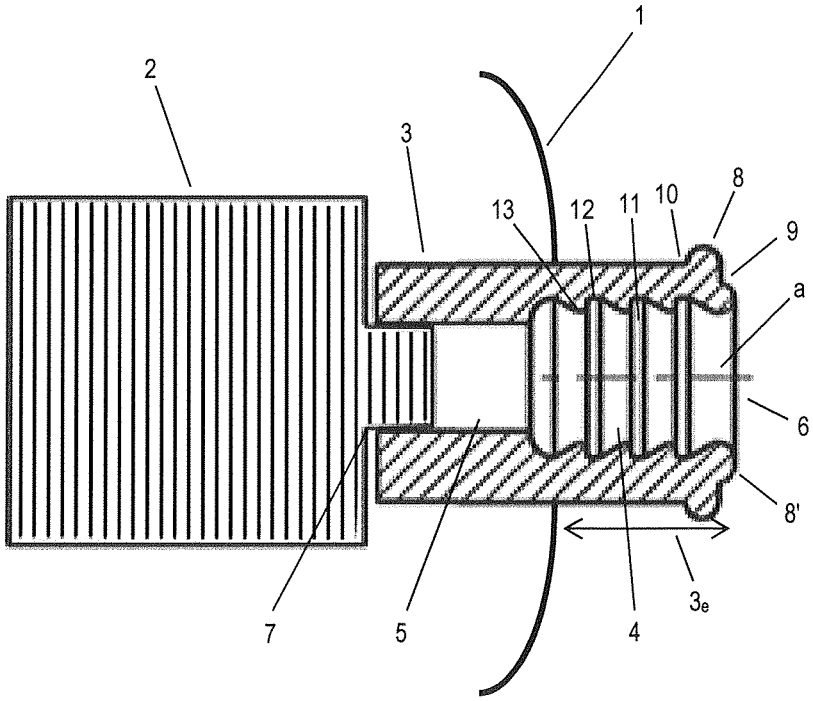
FIG. 2 a simplified cutaway side view of a transducer connected to an exemplary sound tube according to the present invention.

FIG. 2 shows a simplified cutaway side view of a transducer 2 connected to an exemplary sound tube 3 according to the present invention. Here too, the sound tube 3 extends outwards from the earpiece 1, however the inner surface of the outer/front (first) section 4 is structured with a textural pattern forming a relief comprising convexities and/or concavities. In the example illustrated in FIG. 2, the textural pattern is periodic and comprises an alternating series of grooves 11 and ridges 13 extending circumferentially around a longitudinal axis a of the sound tube 3. Furthermore, the structured inner surface comprises inward directed circumferential edges 12. The contour of the inner surface, i.e. the relief, increases the length of the pathway along the inner surface of the sound tube 3 within the first section 4 towards the transducer 2 and the inward pointing edges 12 give rise to capillary effects that hold back contaminants from passing through the outer section 4 of the sound tube 3. Furthermore, the structured outer section 4 of the sound tube 3 is followed by a back/rear (second) section 5, which has a smooth inner surface, whereby the structured surface of the front section 4 forms a "retarding zone" for restraining contaminants, such as cerumen, sweat, oil and other liquids or physiological debris, from passing into the rear section and reaching the transducer 2, and therefore acts as a "buffer zone" between the front (first) end 6 of the sound tube 3 and the rear section 5, which provides a contaminant-free space in front of the sound port of the transducer 3. Moreover, the sound tube 3 features a radially extending, circumferential flange 8 as well as an annular lip 8' at the outer/front end 6 of the sound tube 3. Thereby, the flange 8 is slightly offset from the front end 6 (towards the back/rear end) of the sound tube 3. The flange 8, the annular lip 8' and the outer surface of the sound tube 3 form inward circumferential edges 9, 10. These edges 9, 10 further help to prevent contaminates from entering into the sound tube 3 due to the capillary forces which retain them at the edges 9, 10. The inner diameter of sound tube 3 is in the range between 0.5 mm and 1.5 mm. The individual length of the first and second section 4 and 5 is each on the order of about 1.5 mm±1 mm. The sound tube 3 is for instance made of fluorsilicone having a hardness of 50 Shore A and manufactured by an injection moulding process.

Figure 3:
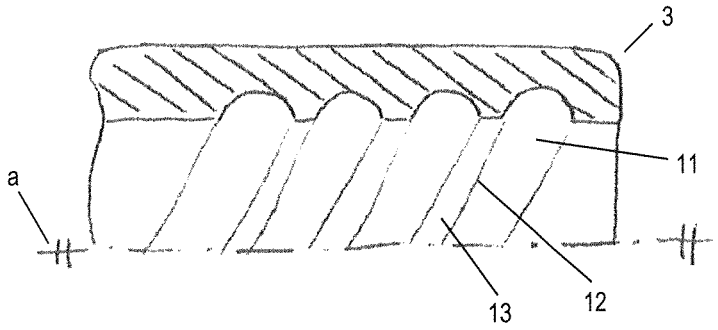
FIG. 3 a simplified cutaway perspective view of an exemplary sound tube according to the present invention.

FIG. 3 shows a simplified cutaway perspective view of an exemplary sound tube 3 according to the present invention clearly illustrating the periodic pattern of radial, circumferential grooves 11 and ridges 13 having edges 12 (which are directed outwardly in this example).

Figure 4:
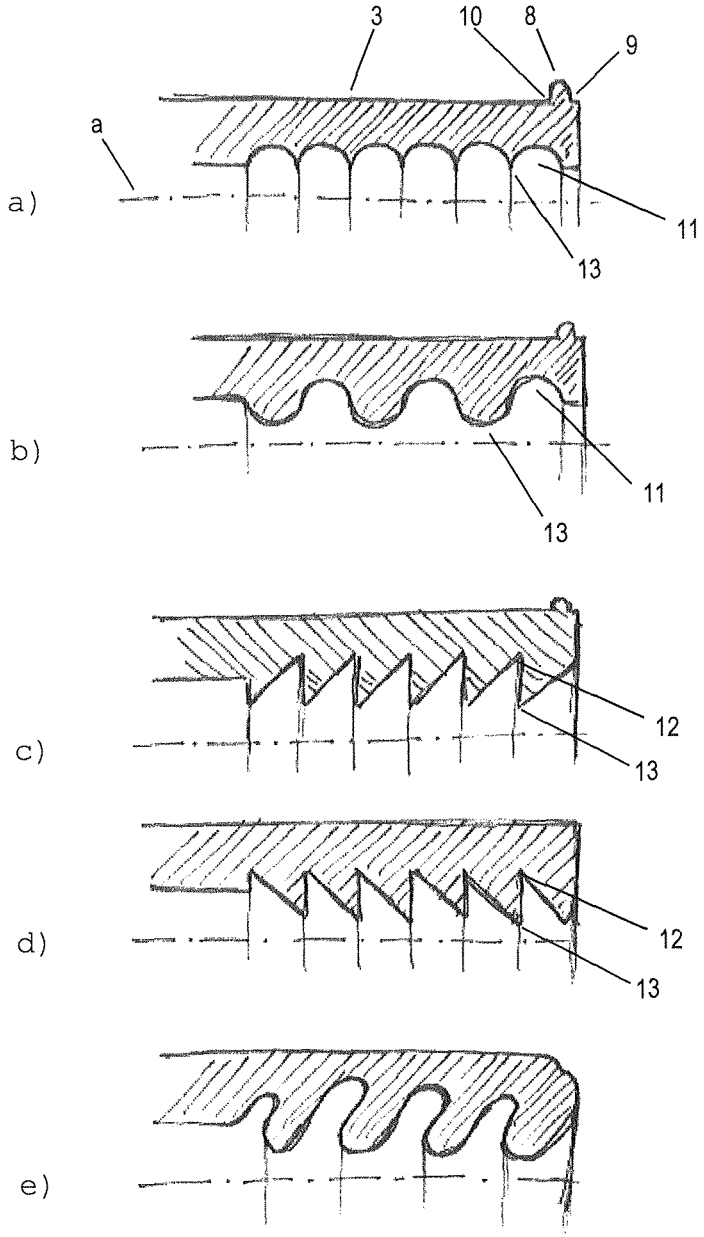
FIG. 4 simplified cutaway side views of various exemplary sound tubes according to the present invention having a structured inner surface whose contour is a) jagged, b) wave-shaped, c) sawtooth-shaped, d) reverse sawtooth-shaped, e) lamellar.

FIG. 4 shows simplified cutaway side views of a plurality of exemplary sound tubes 3 according to the present invention having differently structured inner surfaces. In FIG. 4 *a*) the contour of the inner surface of the sound tube 3 is jagged with sharp ridges 13, which themselves form outwardly pointing edges, and rounded grooves 11, in FIG. 4 *b*) it is wave-shaped with rounded grooves 11 and rounded ridges 13, in FIG. 4 *c*) it is sawtooth-shaped with very distinctive inwardly directed edges 12 and slanted ridges 13 tilted towards the rear end of the sound tube 3, in FIG. 4 *d*) it is reverse sawtooth-shaped, again with very distinctive inwardly directed edges 12, but this time with slanted ridges 13 tilted towards the front end of the sound tube 3, and in FIG. 4 *e*) it is lamellar with ribs/fins slanting towards the rear end of the sound tube 3.

Figure 5:
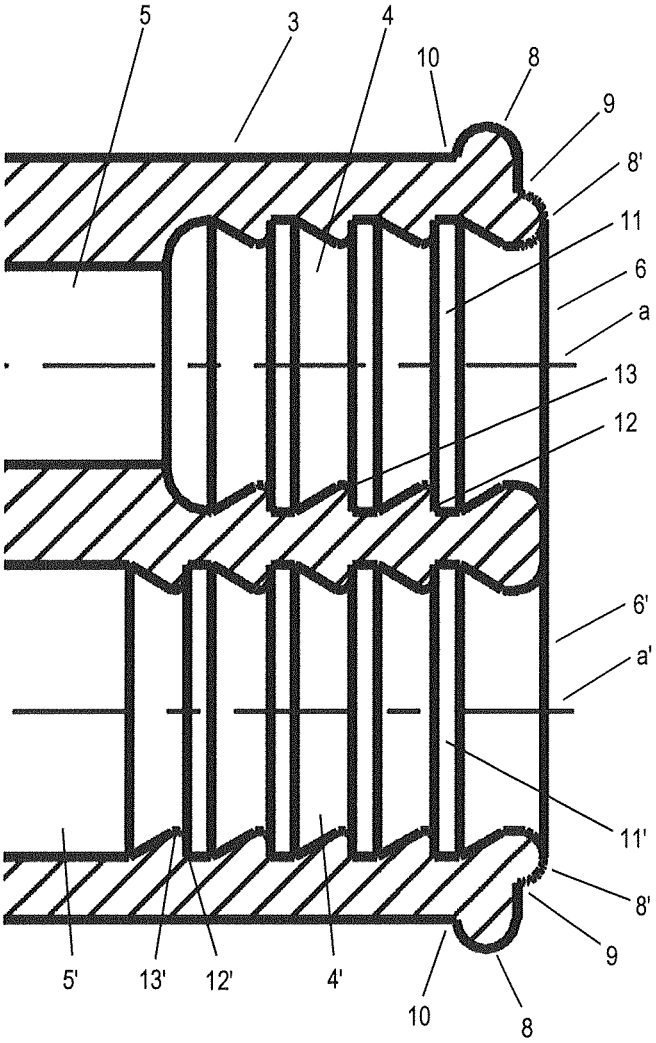
FIG. 5 a simplified cutaway side view of a front portion of an exemplary sound tube arrangement comprising two sound tubes according to the present invention.

Advanced hearing devices employ both a receiver as well as an ear canal microphone in the earpiece, the latter for instance being used in connection with automatic occlusion control in order to improve the perception of the user's own voice when speaking (or other body sounds). The use of two transducers within an earpiece poses several challenges such as achieving a high anatomical fit rate, easy assembly, simple and effective protection against earwax, small mechanical tolerances of the feedback path from the receiver to the ear canal microphone, etc. Moreover, both transducers have to be assembled carefully to achieve a good performance. Known wax protection means do not provide acceptable solutions, because use of two single/separate wax guards is not practical due to their large physical dimensions. FIG. 5 shows a simplified cutaway side view of a front portion of an exemplary sound tube arrangement comprising two sound tubes according to the present invention integrally formed in one piece, i.e. as a single tube having two sound conducting channels. Such a dual sound tube arrangement is well-suited to applications where both a receiver and an ear canal microphone are employed simultaneously in an earpiece. Here the sound tube 3 integrally contains two sound conductions channels, one with an axis a and a front opening 6 through which sound generated by the receiver exits, and the other one with an axis a' and a front opening 6' through which sound to be picked up by the ear canal microphone enters. The sound conduction channels each exhibit the same features as the single sound tube 3 depicted in FIG. 2, i.e. a front (first) section 4, 4' having a structured/textured inner surface and a rear (second) section 5, 5' having a smooth inner surface. Each sound conduction channel has in its front section a series of radial, circumferential grooves 11, 11' and ridges 13, 13' as well as distinct inward directed circumferential edges 12, 12'. Moreover, at its front, outer end the sound tube 3 has a single radially extending, circumferential flange 8 encircling both sound conduction channels as well as a single circumferential lip 8' also encompassing both sound conduction channels. These together with the outer surface of the sound tube 3 form a first inward directed circumferential edge 9 at the front end of the sound tube 3 and a second inward pointing circumferential edge 10 offset away from the front end (towards the rear end) of the sound tube 3.

Figure 6:
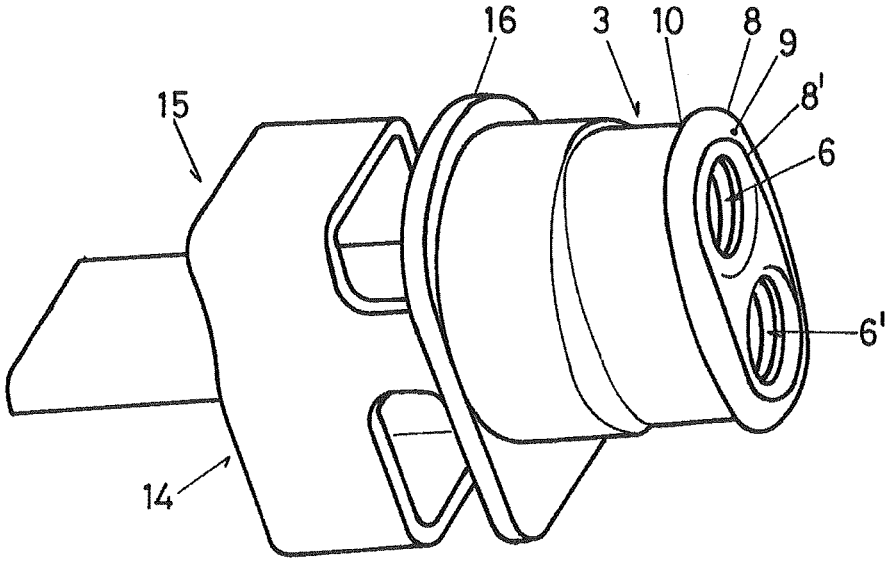
FIG. 6 a simplified cutaway perspective view of an exemplary sound tube arrangement according to the present invention.

FIG. 6 shows a simplified cutaway perspective view of a complete exemplary sound tube arrangement according to the present invention. In this view it can be seen that the flange 8 and the lip 8' surround both front openings 6, 6' of the two sound conduction channels. This exemplary sound tube arrangement further comprises a mounting flange 16 for attaching the arrangement to and/or supporting the arrangement at an earpiece 1, as well as a microphone seating 14 for receiving an ear canal microphone and a receiver seating 15 for receiving a hearing device receiver.

The invention claimed is:

1. A hearing device, comprising:

an earpiece defining an outer surface;

a transducer with a sound port that is lateral of the earpiece outer surface; and a sound tube defining an inner surface, an outer surface, a first section and a second section that is lateral of the first section, the inner surface of the first section having a textural pattern defining convexities and/or concavities and configured to create capillary forces that oppose movement of contaminants out of the first section, at least some of the convexities and/or concavities being located medial of the earpiece outer surface, and the inner surface of the second section lacking convexities and concavities and being mounted on the transducer sound port;

wherein the first and second sections together define an integral one-piece structure.

2. A hearing device as claimed in claim 1, wherein the sound tube defines first and second ends, the first and second sections form the entire inner surface of the sound tube, the first section extends from the first end towards the second end, and the second section extends from the second end towards first end.

3. A hearing device as claimed in claim 1, wherein the textural pattern comprises a periodic textural pattern.

4. A hearing device as claimed in claim 3, wherein the textural pattern is at least one of sawtooth-shaped, wave-shaped, jagged, and lamellar.

5. A hearing device as claimed in claim 1, wherein the textural pattern includes at least one of a groove, a notch, a protrusion, a bulge, and a ridge.

6. A hearing device as claimed in claim 1, wherein the sound tube defines a longitudinal axis and the textural pattern extends circumferentially around the longitudinal axis.

7. A hearing device as claimed in claim 1, wherein the sound tube defines an inner diameter (ID), the textural pattern defines a roughness height (Rz) and an average roughness (Ra), Rz=10 μm to 0.5 ID, and Ra=10 μm to 1 mm.

8. A hearing device as claimed in claim 1, wherein the textural pattern is configured to restrain cerumen, sweat, oil and other liquids, and physiological debris from passing through the sound tube.

9. A hearing device as claimed in claim 1, wherein the transducer comprises a receiver;

the sound tube comprises first and second sound conduction channels, each having a textural pattern defining convexities and/or concavities;

the sound port of the receiver is connected to the first sound conduction channel; and the hearing device further comprises a microphone connected to the second sound conduction channel.

10. A sound tube for use with an earpiece that includes a transducer with a sound port, the sound tube comprising:

a tubular body defining an outer surface and an inner surface with contiguous first and second portions, a medial end associated with the first portion, and a lateral end associated with the second portion;

a textural pattern defining convexities and/or concavities formed in the first portion of the inner surface of the tubular body;

the second portion of the inner surface of the tubular body lacking convexities and/or concavities;

a flange, defining a medial end, that extends outwardly from the tubular body such that the medial end of the flange is located a predetermined non-zero lateral distance from the medial end of the tubular body; and means for mounting the tubular body onto the sound port such that the second portion of the inner surface of the tubular body extends from the sound port to the first portion of the inner surface of the tubular body.

11. A sound tube as claimed in claim 10, wherein the textural pattern comprises a periodic textural pattern.

12. A sound tube as claimed in claim 11, wherein the textural pattern is at least one of sawtooth-shaped, wave-shaped, jagged, and lamellar.

13. A sound tube as claimed in claim 10, wherein the textural pattern includes at least one of a groove, a notch, a protrusion, a bulge, and a ridge.

14. A sound tube as claimed in claim 10, wherein the tubular body defines a longitudinal axis and the textural pattern extends circumferentially around the longitudinal axis.

15. A sound tube as claimed in claim 10, wherein the tubular body defines an inner diameter (ID), the textural pattern defines a roughness height (Rz) and an average roughness (Ra), Rz=10 μm to 0.5 ID, and Ra=10 μm to 1 mm.

16. A sound tube as claimed in claim 10, wherein the textural pattern is configured to restrain cerumen, sweat, oil and other liquids, and physiological debris from passing through the tubular body.

17. A hearing device as claimed in claim 1, wherein the first section textural pattern defines convexities and concavities; and the concavities define concavity inner diameters and the inner surface of the second section defines an inner diameter that is less than the concavity inner diameters.

18. A hearing device as claimed in claim 17, wherein the convexities define convexity inner diameters and the diameter of the inner surface of the second section is less than the convexity inner diameters.

19. A hearing device as claimed in claim 1, wherein the sound tube defines a medial end; and the sound tube includes a flange, defining a medial end, that extends outwardly from the first portion in such a manner that the medial end of the flange is lateral of the medial end of the sound tube.

20. A sound tube as claimed in claim 10, wherein the tubular body and the flange include respective outer surfaces that intersect and define a circumferential edge that creates a capillary force.

21. A sound tube as claimed in claim 10, wherein the tubular body defines a length; and the predetermined non-zero lateral distance is less than 1/10 of the length of the tubular body.

* * * * *